United States Patent [19]

Matthes

[11] 4,124,904

[45] Nov. 14, 1978

[54] PROTECTIVE HEAD GEAR

[76] Inventor: John A. Matthes, Box 144, Rhinecliff Rd., Rhinecliff, N.Y. 12574

[21] Appl. No.: 842,750

[22] Filed: Oct. 17, 1977

[51] Int. Cl.[2] ..... A42B 3/02; A63B 71/10

[52] U.S. Cl. ..... 2/413

[58] Field of Search ..... 2/413, 410, 412, 414, 2/425, 411

[56] References Cited

U.S. PATENT DOCUMENTS

| | | | |
|---|---|---|---|
| 3,462,763 | 8/1969 | Schneider et al. | 2/413 |
| 3,787,893 | 1/1974 | Larcher | 2/413 |
| 3,806,950 | 4/1974 | Spencer-Foote | 2/413 |
| 3,873,997 | 4/1975 | Gooding | 2/413 |
| 3,925,821 | 12/1975 | Lewicki | 2/425 |
| 3,999,220 | 12/1976 | Keltner | 2/413 |
| 4,024,586 | 5/1977 | Lamb | 2/414 |

*Primary Examiner*—Louis K. Rimrodt
*Attorney, Agent, or Firm*—Howard I. Podell

[57] ABSTRACT

A helmet or the like which has a rigid central shell and inner and outer inflatable impact absorbing liners with one-way valve means for inflating same. A plurality of inserts of foam or spongy material is secured to the inner shell and adapted to contact the head of the wearer. The liners may be removably secured to the shell.

6 Claims, 3 Drawing Figures

PROTECTIVE HEAD GEAR

FIELD OF THE INVENTION

This invention relates generallly to improvements in protective headgear for use in sports, law enforcement, industry or the military.

STATEMENT OF THE PRIOR ART

The prior art, as exemplified by U.S. Pat. Nos. 3,186,004; 3,310,811; 3,353,187; 3,872,511 and 3,787,893 is generally illustrative of various devices of this type. While such devices are generally acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention, is to provide a device or article of this character which combines simplicity, strength and durability in a high degree, together with inexpensiveness of construction.

Other objects of this invention will in part be obvious and in part hereinafter pointed out.

SUMMARY OF THE INVENTION

This invention resides in a helmet or the like which has a rigid central shell and inner and outer inflatable impact absorbing liners with one-way valve means for inflating same to partial capacity. A plurality of inserts of foam or spongy material is secured to the inner shell and adapted to contact the head of the wearer. The liners may be removably secured to the shell.

BRIEF DESCRIPTION OF THE DRAWINGS

In the accompanying drawing, in which is shown and illustrated one of the various possible illustrative embodiments of this invention, wherein like reference character identify the same or like parts.

DESCRIPTION OF THE PREFERRED EMBODIMENT

Figure 1:
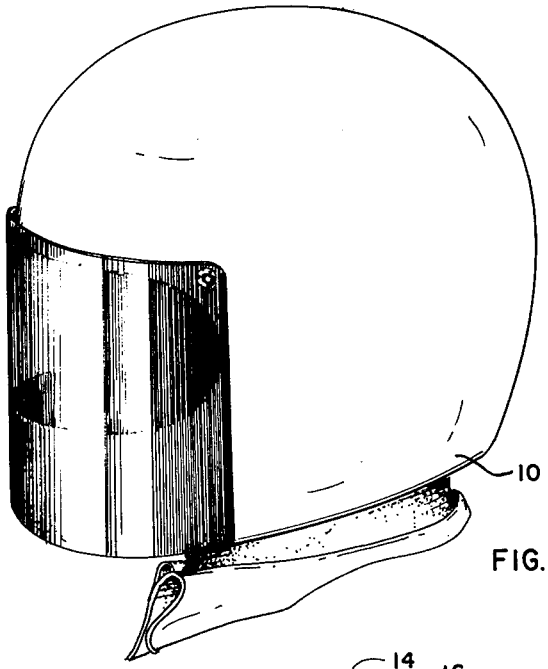
FIG. 1 is a perspective view of the protective gear of ths invention.

With reference to the drawing, there is shown and illustrated a protective helmet constructed in accordance with the principles of the invention and designated generally by reference character 10.

The helment 10 consists of a one piece molded shell of cycolac, polycarbonate or of metal or other impact resistent material. Shell 12 can be constructed in any of the various standard head sizes.

Figure 2:
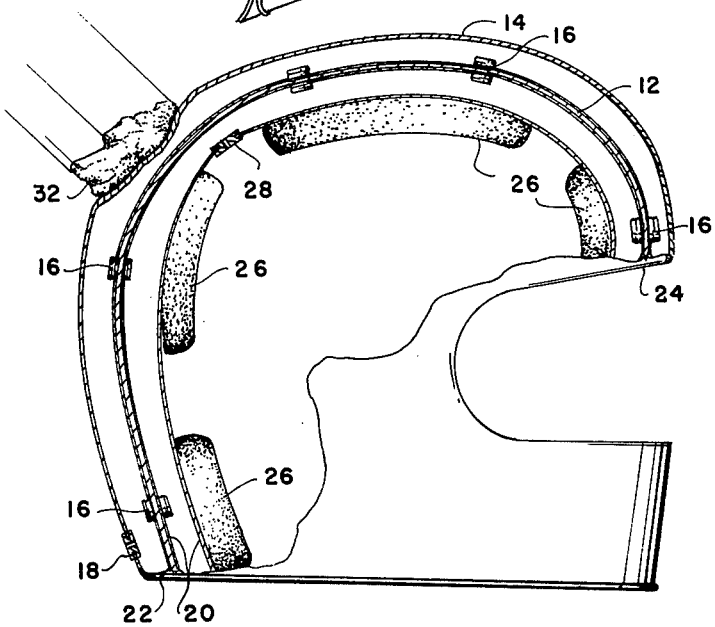
FIG. 2 is a sectional view thereof shown at impact.

An outer protective liner 14 is secured over the entire shell 12 by adhesive if it is desired to have it on permanently or by sealed snaps or rivets 16, as shown for the removable version of FIG. 2. Liner 14 is made of firm, resilient plastic such as vinyl plastic, polypropylene or of rubber. A check or one-way valve 18 is provided in liner 14 for inflating same partial capacity with the needle of a pressurized device or a pump. A similar, inner, liner 20 is secured over the entire inside surface of shell 12 and can be adhered thereto as above noted or removably attached by snaps or rivets 16 which also hold the outer liner 14.

Below the snaps or rivets 16 if such are used or equally spaced between the cervical area 22 and the forehead 24 are foamed plastic inserts 26 or polyurethane which are adhered by acrylic or other adhesive to the bottom of inner liner 20. Inner liner 20 has a check valve 28 for inflating same.

For best results it is preferred that the liners be inflated to ½ to ⅞ of their capacities as shown in FIG. 2. Upon impact by a blunt instrument 32, the liners are deformed but the volume of air therein equalizes by absorbing the shock as do also inserts 26, thereby effectively mitigating damage to the brain or skull of the wearer.

Among the advantages of the invention is the fact that the outer liner can be made of various colors so that by changing same, one helmet type can be used for several sports. Naturally, the liners and inserts may be retrofitted on existing helmets if these are otherwise structurally sound.

Figure 3:
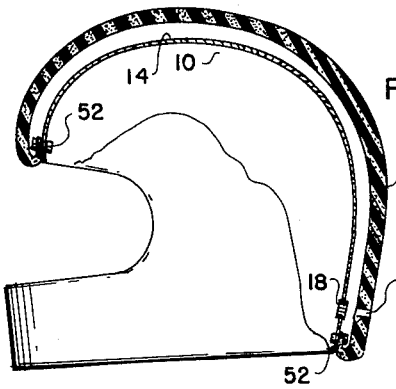
FIG. 3 is a sectional view of an attachable outer liner cover.

As shown in FIG. 3, an outer liner cover 50 may be detachably fastened over outer liner 14 by snap fasteners 52. A hole 53 is located in cover 50 adjacent filling check valve 18 in liner 14. Cover 50 may be fabricated of canvas, leather, perforated plastic or other porous flexible material.

The operation and use of the invention hereinabove described will be evident to those skilled in the art to which it relates from a consideration of the foregoing.

It will thus be seen that there is provided a device in which it relates from a consideration of the foregoing.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size, suitable material and arrangement of the elements of this invention as claimed may be resorted to in actual practice, if desired.

Having thus described the invention, what is claimed as new and to be secured by Letters Patent is:

1. In a protective helmet, a rigid shell adapted to fit over a human head, an outer inflatable liner secured over substantially the entire outer surface of said shell; and an inner inflatable liner secured over substantailly the entire inner surface of said shell and a plurality of spaced foamed sponge-like inserts attached to the inner surface of said inner liner, in which each said liner is fitted with independent check valve inlet means so that each liner may be independently inflated, and maintained in the inflated condition, independently of the other liner.

2. The invention as recited in claim 1, wherein said liners are permanently secured to said shell.

3. The invention as recited in claim 1, including a plurality of sealed snaps passing through said liners for removably securing said liners to said shell.

4. The invention as recited in claim 1, together with a flexible porous cover fitted with means to detachably fasten over the outer inflatable liner.

5. The invention as recited in claim 1, wherein each said liner is inflated to a partial air capacity of the respective liner.

6. The invention as recited in claim 5, wherein each said liner is inflated within the range of one-half to two-thirds of its capacity.

* * * * *